United States Patent [19]

Schneider

[11] Patent Number: 4,984,377

[45] Date of Patent: Jan. 15, 1991

[54] ALL CONDITION FISHING WADERS

[76] Inventor: Gottlieb R. Schneider, 4410 N. 13 East, Mountain Home, Id. 83647

[21] Appl. No.: 448,536

[22] Filed: Dec. 11, 1989

[51] Int. Cl.[5] ..... A43B 5/00

[52] U.S. Cl. ..... 36/134; 36/67 A; 36/67 B; 36/67 D

[58] Field of Search ..... 32/67 A, 67 B, 67 D, 32/134

[56] References Cited

U.S. PATENT DOCUMENTS

| | | | |
|---|---|---|---|
| 1,025,087 | 4/1912 | Hart | 36/67 D |
| 1,782,569 | 11/1930 | Howard | 36/67 B |
| 2,034,050 | 3/1936 | Levy | 36/67 B |
| 2,118,107 | 5/1938 | Riddeu | 36/67 D |
| 2,697,288 | 12/1954 | Wilcox | 36/67 B |
| 3,735,507 | 5/1973 | Granger | 36/67 D X |
| 3,775,874 | 12/1973 | Bonneville | 36/67 D |
| 4,083,126 | 4/1978 | Pelletier | 36/67 D |
| 4,414,763 | 11/1983 | Bente | 36/134 |
| 4,644,672 | 2/1987 | Dassler et al. | 36/134 |
| 4,782,604 | 11/1988 | Wen-Shown | 36/67 D X |

FOREIGN PATENT DOCUMENTS

| | | | |
|---|---|---|---|
| 1221496 | 4/1959 | France | 36/59 R |
| 10657 | of 1889 | United Kingdom | 36/67 B |

*Primary Examiner*—Paul T. Sewell
*Assistant Examiner*—BethAnne C. Cicconi
*Attorney, Agent, or Firm*—Leon Gilden

[57] ABSTRACT

Conventional fishing waders are made adaptable for use under a plurality of conditions by utilizing different types of removably attachable spikes and cleats. Additionally, the soles of the waders may be covered with a felt material. The removable spikes are used with sand and gravel surfaces, and the removable metal cleats are best used for swift moving water and slippery rocks. The felt covered soles provide improved wader traction over larger sizes of gravel and rocks.

1 Claim, 5 Drawing Sheets

PRIOR ART

PRIOR ART

ALL CONDITION FISHING WADERS

BACKGROUND OF THE INVENTION

1. Field of the Invention

The present invention relates to fishing waders, and more particularly pertains to new and improved sole constructions for such waders wherein improved traction for the user is provided.

2. Description of the Prior Art

The use of waders for fishing and other water related activities is well known in the prior art. As can be appreciated, these types of waders are most often worn by individuals who are wading in water—usually while fishing. Quite frequently, the user of such waders must traverse slippery rocks and gravel and may also encounter swiftly moving water. Accordingly, conventional fishing waders are usually provided with integrally molded gripping soles for the purpose of supporting a user under slippery conditions.

It is a well recognized fact in the shoe and boot industry that no one sole design will provide the best traction under all conditions. As such, there has been developed a large number of antislipping devices which may be attached to the soles of shoes, boots and the like for the purpose of providing improved traction when needed. Such devices are well known in the prior art, and the ones most pertinent to the subject matter of the present invention are subsequently discussed under the description of the preferred embodiments. In any respect, none of these prior art devices are suitably designed for use with hip boot waders and accordingly, there appears to be a substantial need for antislipping devices particularly designed for use with such waders. In this regard, the present invention substantially addresses this need.

SUMMARY OF THE INVENTION

In view of the foregoing disadvantages inherent in the known types of fishing waders now present in the prior art, the present invention provides an improved fishing wader construction wherein both permanently attached and removable structures are operably attached to the soles of fishing waders for the purpose of providing improved traction under various conditions. As such, the general purpose of the present invention, which will be described subsequently in greater detail, is to provide a new and improved fishing wader construction which has all the advantages of the prior art fishing waders and none of the disadvantages.

To attain this, the present invention envisions a modified sole construction wherein the soles of conventional fishing waders are completely covered with a felt material. The felt material provides for improved traction for a user over larger gravel and rocks—especially when the rocks and gravel are immersed beneath water. Additionally, metal cleats are threadably attachable to the soles of the waders with such threaded attachment being accomplished through the felt covering. The cleats provide additional traction on slippery rocks and if necessary, sharp pointed metallic spikes can be threadably attached to the cleats to provide even further gripping power in sand and gravel.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out it various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved fishing wader construction which has all the advantages of the prior art fishing wader constructions and none of the disadvantages.

It is another object of the present invention to provide a new and improved fishing wader construction which may be easily and efficiently manufactured and marketed.

It is a further object of the present invention to provide a new and improved fishing wader construction which is of a durable and reliable construction.

An even further object of the present invention is to provide a new and improved fishing wader construction which is susceptible of a low cost of manufacture with regard to both materials and labor, and which accordingly is then susceptible of low prices of sale to the consuming public, thereby making such fishing wader constructions economically available to the buying public.

Still yet another object of the present invention is to provide a new and improved fishing wader construction which provides in the apparatuses and methods of the prior art some of the advantages thereof, while simultaneously overcoming some of the disadvantages normally associated therewith.

Still another object of the present invention is to provide a new and improved fishing wader construction which facilitates the modification of the sole gripping surfaces thereof to accommodate various conditions.

Yet another object of the present invention is to provide a new and improved fishing wader construction which envisions the providing of kits which allow conventional fishing waders to be modified to accommodate the intent and purpose of the present invention.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENTS

Figure 1:
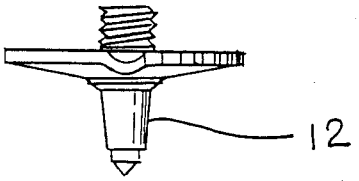
FIG. 1 is a side elevation view of a conventional metallic spike of the type used in the prior art.

With reference now to the drawings, a new and improved all condition wader construction embodying the principles and concepts of the present invention and generally designated by the reference numeral 10 will be described.

Figure 2:
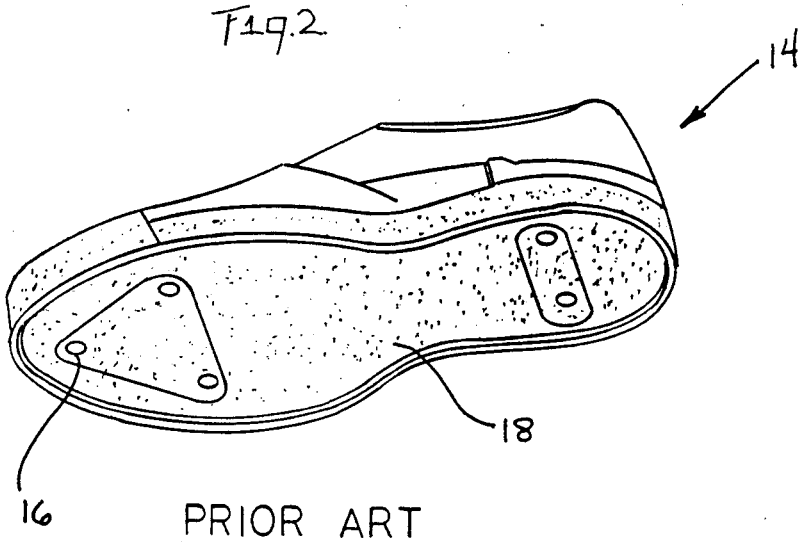
PRIOR ART Fig. 2
FIG. 2 is a perspective view of a shoe sole which is designed to accommodate the spike of FIG. 1.

In this regard, there has already been developed several different cleat and spike constructions which are utilizable with conventional boots and shoes, but which are not particularly adapted for use with waders. For example, FIG. 1 shows a prior art spike 12 which is designed for threadable attachment to the sole of a shoe—in particular a golf shoe. This spike 12 is specifically described in U.S. Pat. No. 3,552,043, which issued to L. J. Moffa on Jan. 5, 1971, and requires a metal insert to be positioned in the sole of the associated shoe. The metal insert must include a threaded bore and can be designed in various configurations as shown in FIG. 2. By the same token, FIG. 2 illustrates a prior art shoe construction 14 which includes a plurality of threaded bore inserts 16 secured to the sole 18 thereof. The illustrated construction in FIG. 2 is more particularly described in U.S. Pat. No. 3,526,976 which issued to C. E. Jacobs on Sept. 8, 1970.

Figure 3:
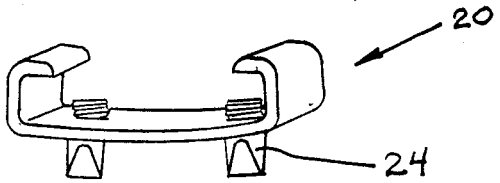
FIG. 3 is a perspective view of a modified prior art cleat construction.
Figure 4:
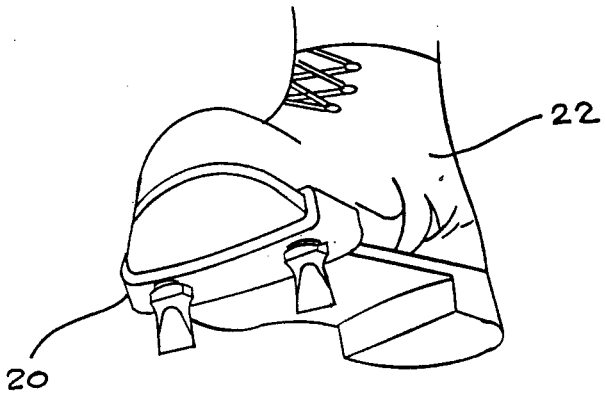
PRIOR ART Fig. 4.
FIG. 4 is a perspective view of the FIG. 3 cleat construction operably attached to a boot.

The above-discussed Moffa and Jacobs patents are illustrative of the approach of having modified shoe soles designed to receive interchangeable spikes and cleats. However, the prior art has also recognized the need for separably attachable cleat constructions which do not require the modification of existing shoe soles. In this regard, FIG. 3 of the drawings illustrates a removable cleat assembly that is more particularly described in U. S. Pat. No. 1,573,779 which issued to F. G. Broman on Feb. 16, 1926. As best shown in FIG. 4, the Broman cleat assembly can be adjustably positioned over the sole edges of a boot or shoe 22 and securely attached thereto by the threadable movement of the individual cleats 24. While this type of cleat design is useful with shoes having well defined sole constructions, it can be understood that such removable cleats would not function well with waders inasmuch as these waders generally make use of integrally molded soles having no defined edges. Accordingly, it would be next to impossible to effectively secure a cleat assembly thereto.

Figure 5:
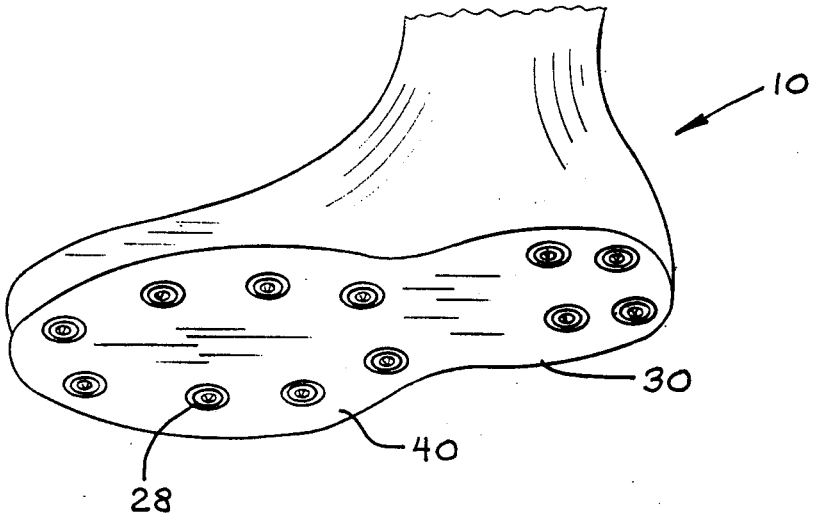
FIG. 5 is a perspective view of a modified fishing wader sole which employs the use of the present invention.

FIG. 5 of the drawings illustrates a first preferred embodiment 10 of the present invention. More specifically, a detail view of a shoe 26 forming a part of a conventional set of waders may be provided with a spaced pattern of metallic spikes 28 integrally or otherwise fixedly secured to a sole portion 30 thereof. In this connection, FIG. 5 illustrates a basic configuration of four spikes 28 located in the heel portion of the sole 30 with an additional eight spikes then being secured towards the toe portion of the sole.

Figure 6:
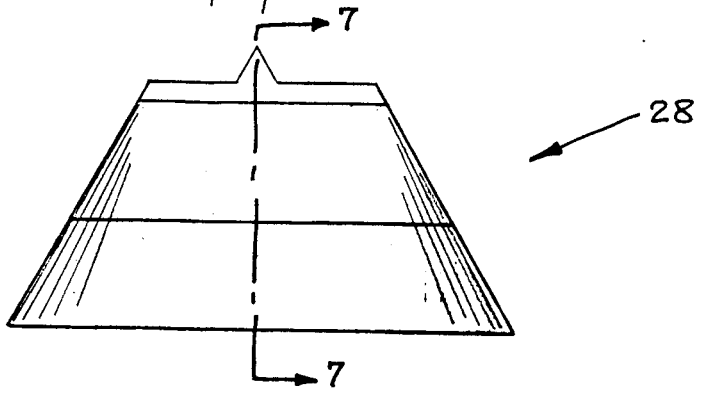
FIG. 6 is an elevation view of the combination cleat and spike construction comprising one embodiment of the present invention.
Figure 7:
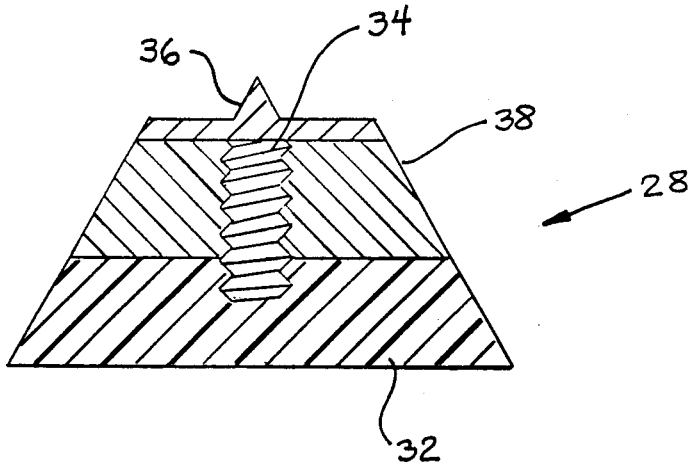
FIG. 7 is a cross sectional view of the invention shown in FIG. 6.

FIGS. 6 and 7 illustrate an enlarged version of the spikes shown in FIG. 5. In this regard, each spike 28 could consist of an elastomeric base structure 32 shaped in the form of a truncated cone. The rubber base structure 32 could be selectively adhesively attached, such as by thermo-welding or the like, to the rubber soles 30 of a pair of waders or alternatively, the base 32 could be integrally molded into a sole at the time the waders are manufactured.

With continuing reference to FIGS. 6 and 7, it can be seen that the base 32 is designed to receive the threaded shank 34 of a metallic spike member 36. A truncated-cone shaped metal member 38 includes a centrally disposed threaded bore for also receiving the shank 34, and this cone shaped metallic member is designed to be positioned between the spike plate 36 and the rubber base 32. In effect, the metallic member 38 serves as a spacer which increases the height of the spiked member 28 so as to allow it to function more in the manner of prior art cleats.

From this description of the first embodiment of the invention as particularly illustrated in FIGS. 6 and 7, it can be appreciated that the spike plate 36 can be utilized without the metallic member 38, and this construction provides for good traction over sand and gravel surfaces. The addition of the metallic member 38 between the spike plate 36 and the rubber base 32 effectively defines a cleat and provides for improved traction over larger size gravel and rocks—particularly where swift moving water is flowing over the rocks and gravel. To complete the construction of the first embodiment of the invention, it also desirable to provide for even greater sole traction on gravel and rocks, and this is accomplished by covering the sole 30 with a layer of felt 40. This felt covering is illustrated in FIG. 5 and could be secured to the sole 30 of the shoe 26 at the time of manufacture. Alternatively, attachable felt pads formed in the shape of the soles 30 could be made available to the user in place of metallic member 38 between spike plate 36 and rubber base 32.

Figure 8:
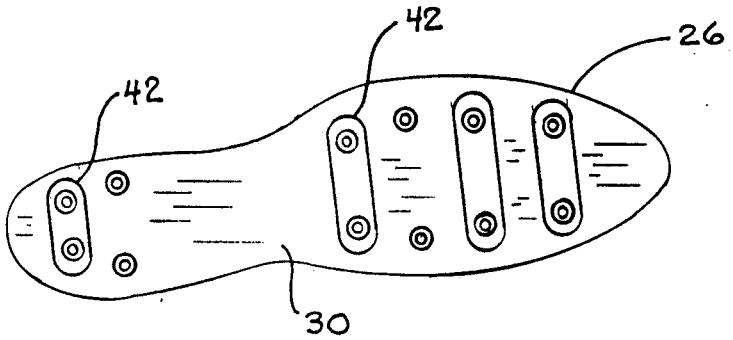
FIG. 8 is a bottom plan view of a fishing wader utilizing modified embodiments of the present invention.
Figure 9:
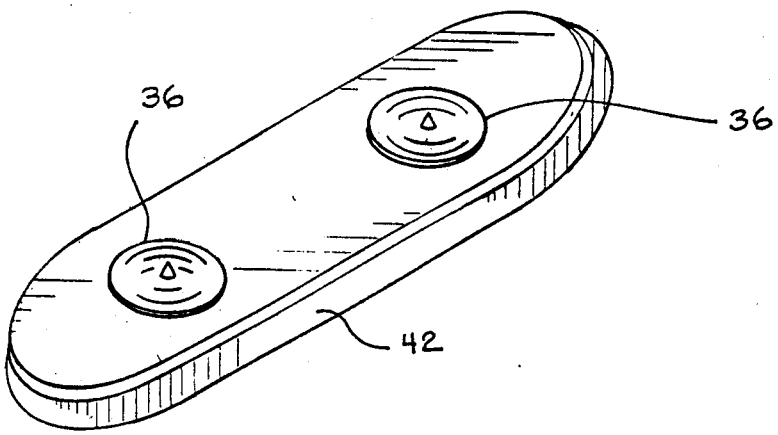
FIG. 9 is a perspective view of the modified cleat construction shown in FIG. 8.
Figure 10:
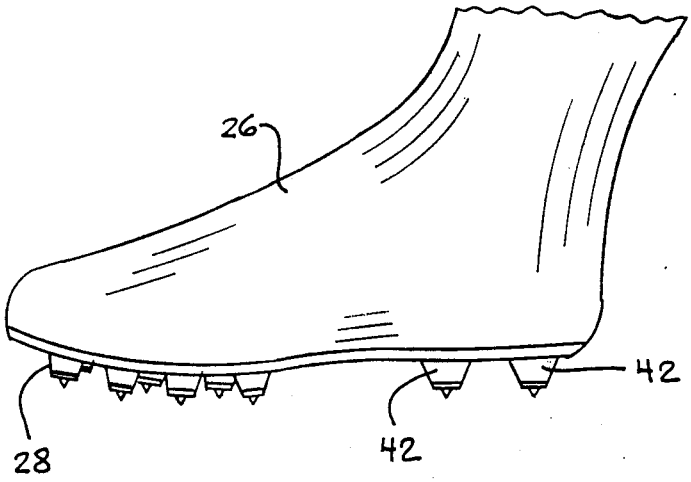
FIG. 10 is a side elevation view of a wader showing a use of the cleat construction shown in FIG. 8.

FIG. 8 of the drawings illustrates a modification of the invention wherein one or more metallic plates 42 are molded into the sole 30 of a shoe 26. As more clearly illustrated in FIG. 9, the metallic plates 42 could be provided with any number of threaded opening to receive threadably attachable spike plates 36, while a thick felt pad 40 could be positioned between the spike plates 36 and the metal bars 42. FIG. 10 shows the side view of a wader shoe 26 having a combination of metal bars 42 and adjustable height cleats 28 attached to the sole portion thereof.

With respect to the manner of usage and operation of the present invention, the same should be apparent from the above description. Accordingly, no further discussion relative to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved cleat assembly in combination with waders wherein the waders include a bottom sole portion, the assembly comprises, cleat means fixedly securable to the bottom sole portion of said waders;

and a plurality of metallic spike means for selective attachment to said cleat means, wherein said cleat means include at least one metallic bar member, attached to said sole portion of said waders, wherein said metallic spike means are threadably attached to said bar member, wherein a metallic spacer is positioned between said metallic spike means and said bar member, and wherein said spacer means are of a truncated cone shape, said metallic spike means being threadedly attached to said spacer means, and including additional traction means for selectively imparting enhanced traction to the spike means, wherein said additional traction means comprises felt pad means attachable to said sole, and each of the cleat means includes an elastomeric truncated conical base mounted to the bar member underlying coaxially aligned with the spacer, and each of the cleat means includes a spike plate member defining a plate including a projection directed outwardly therefrom, and each plate member including a threaded shank underlying and fixedly mounted to each plate member receivable within the spacer.

* * * * *